US009791142B2

(12) United States Patent
Favarolo et al.

(10) Patent No.: US 9,791,142 B2
(45) Date of Patent: Oct. 17, 2017

(54) LAMP HAVING AIR-CONDUCTING SURFACES AND AIR PASSAGE OPENINGS

(71) Applicant: ZUMTOBEL LIGHTING GMBH, Dornbirn (AT)

(72) Inventors: Angelo Favarolo, Wangen (DE); Wolfgang Gadner, Hoerbranz (AT); Gerald Ladstaetter, Klaus (AT)

(73) Assignee: ZUMTOBEL LIGHTING GMBH, Dornbirn (AT)

( * ) Notice: Subject to any disclaimer, the term of this patent is extended or adjusted under 35 U.S.C. 154(b) by 122 days.

(21) Appl. No.: 14/649,094

(22) PCT Filed: Dec. 3, 2013

(86) PCT No.: PCT/EP2013/075367
§ 371 (c)(1),
(2) Date: Jun. 2, 2015

(87) PCT Pub. No.: WO2014/086770
PCT Pub. Date: Jun. 12, 2014

(65) Prior Publication Data

US 2015/0300624 A1 Oct. 22, 2015

(30) Foreign Application Priority Data

Dec. 4, 2012 (DE) ..... 10 2012 222 184

(51) Int. Cl.
*F21S 8/06* (2006.01)
*F21V 29/83* (2015.01)
(Continued)

(52) U.S. Cl.
CPC ..... *F21V 29/83* (2015.01); *F21S 8/06* (2013.01); *F21V 7/005* (2013.01); *F21V 29/004* (2013.01);
(Continued)

(58) Field of Classification Search
CPC F21S 8/026; F21S 8/038; F21S 8/043–8/088; F21S 2/005; F21V 23/008;
(Continued)

(56) References Cited

U.S. PATENT DOCUMENTS 3,710,094 A 1/1973 Monte et al.
4,497,016 A 1/1985 Sachse
(Continued)

FOREIGN PATENT DOCUMENTS

CH 192444 8/1937
DE 8233139 5/1983
(Continued)

OTHER PUBLICATIONS

International Search Report for PCT/EP2013/075367, English translation attached to original, Both completed by the European Patent Office dated Apr. 4, 2014, All together 7 Pages.
(Continued)

*Primary Examiner* — Anh Mai
*Assistant Examiner* — Steven Horikoshi
(74) *Attorney, Agent, or Firm* — Brooks Kushman P.C.

(57) ABSTRACT

A lamp, which has a light source having several light-emitting elements, in particular in the form of LEDs. The lamp has first passage openings on a first side next to the light source and second passage openings on a second side next to the light source. The passage openings are designed for an air flow for cooling the light source. The lamp also has a first air-conducting surface on the first side next to the first passage openings and below the light source and a second air-conducting surface on the second side next to the second passage openings and below the light source, wherein the two air-conducting surfaces are designed in such a way that the two air-conducting surfaces form an air incidence region that expands away from the light source.

13 Claims, 5 Drawing Sheets

Figure 1:
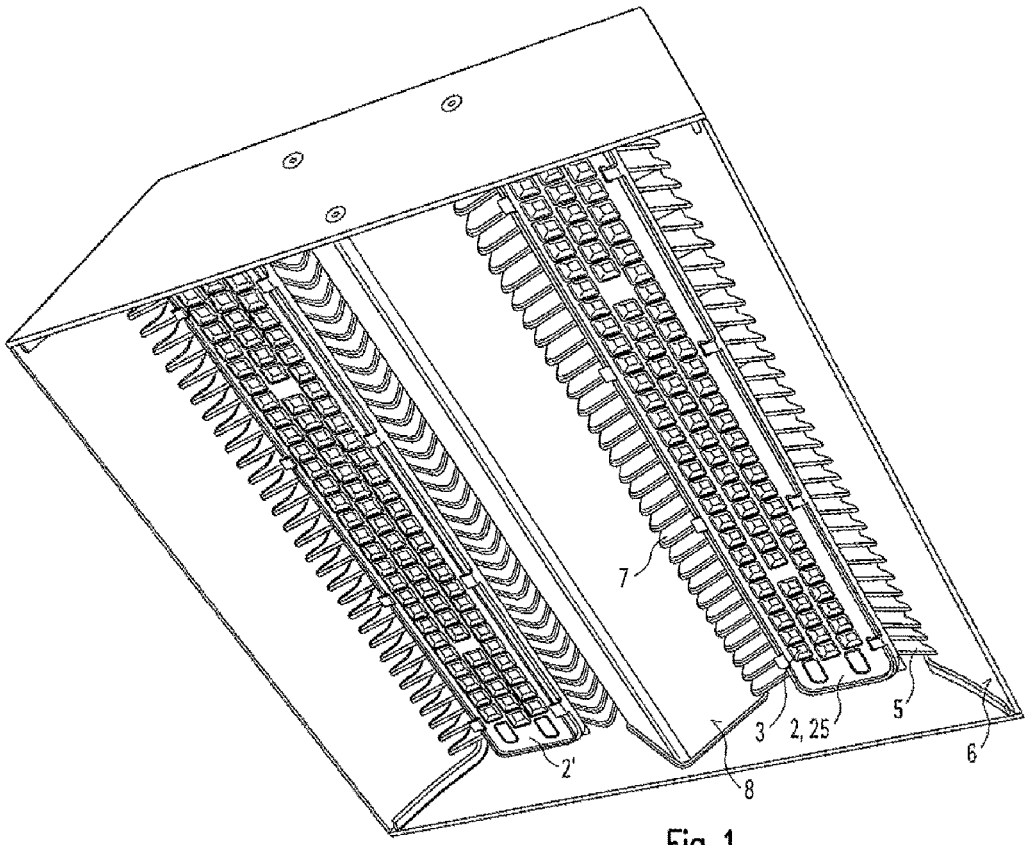

(51) Int. Cl.

| | |
|---|---|
| ***F21V 29/00*** | (2015.01) |
| ***F21V 7/00*** | (2006.01) |
| *F21W 131/105* | (2006.01) |
| *F21W 131/407* | (2006.01) |
| *F21Y 105/10* | (2016.01) |
| *F21Y 115/10* | (2016.01) |

(52) U.S. Cl.
CPC . *F21W 2131/105* (2013.01); *F21W 2131/407* (2013.01); *F21Y 2105/10* (2016.08); *F21Y 2115/10* (2016.08)

(58) Field of Classification Search
CPC ..... F21V 23/023; F21V 29/004; F21V 29/83; F21V 7/009; F21V 7/02; F21V 7/026; F21W 2131/105; F21W 2131/40; F21W 2131/402; F21W 2131/407
See application file for complete search history.

(56) References Cited

U.S. PATENT DOCUMENTS

| | | | | |
|---|---|---|---|---|
| 6,350,046 | B1 | 2/2002 | Lau | |
| 8,702,264 | B1 * | 4/2014 | Rashidi | F21S 8/026 362/147 |
| 2008/0285271 | A1 | 11/2008 | Roberge et al. | |
| 2010/0020492 | A1 | 1/2010 | Luo | |
| 2010/0097799 | A1 * | 4/2010 | Shin | F21V 29/004 362/235 |
| 2011/0013402 | A1 | 1/2011 | Little, Jr. | |
| 2011/0018418 | A1 | 1/2011 | Yoo | |
| 2011/0317420 | A1 | 12/2011 | Joen et al. | |
| 2012/0051050 | A1 * | 3/2012 | Lee | F21S 2/005 362/235 |
| 2012/0147603 | A1 | 6/2012 | Hochstein | |
| 2013/0088864 | A1 * | 4/2013 | Verdes | F21V 29/004 362/235 |
| 2013/0120998 | A1 | 5/2013 | Oehle et al. | |

FOREIGN PATENT DOCUMENTS

| | | |
|---|---|---|
| DE | 20202558 | 7/2003 |
| DE | 102006018984 | 10/2007 |
| DE | 102008006535 | 7/2009 |
| DE | 102009014063 | 9/2010 |
| DE | 202011003010 | 5/2011 |
| DE | 102011008613 | 7/2011 |
| DE | 102010002235 | 8/2011 |
| DE | 102010007538 | 8/2011 |
| DE | 102011081369 | 2/2013 |
| WO | 2011157836 | 12/2011 |

OTHER PUBLICATIONS

German Search Report for German Application No. DE 10 2012 222 184.0 dated Jul. 17, 2013, 5 Pages.

* cited by examiner

LAMP HAVING AIR-CONDUCTING SURFACES AND AIR PASSAGE OPENINGS

CROSS-REFERENCE TO RELATED APPLICATION

This application is the U.S. national phase of PCT Application No. PCT/EP2013/075367 filed on Dec. 3, 2013, which claims priority to DE Patent Application No. 10 2012 222 184.0 filed on Dec. 4, 2012, the disclosures of which are incorporated in their entirety by reference herein.

The invention relates to a lamp having a light source and passage openings formed beside the light source for an air flow for cooling the light source.

Heat in the form of lost heat is generally generated by light emitting elements, such as for example incandescent lamps, fluorescent tubes, LEDs (LED: light emitting diode) and so on when they are in a state in which they are emitting light. In particular if a light source of a lamp has LEDs as light emitting elements, it is necessary to ensure, for reliable operation of the lamp, that this heat is effectively transported away. Otherwise, it is possible, for example, for damage to the LEDs and/or an unintendedly changed emission behavior of the LEDs to occur.

For the appropriate cooling of LEDs, heat sinks which are thermally highly conductively connected to the LEDs are usually used. An LED downlight having such a heat sink is known, for example from the specification DE 10 2010 002 235 A1. The heat sink of this downlight has vertically configured cooling ribs, as a result of which the surface of the heat sink is particularly large and thus a particularly good discharge of heat to the surroundings is made possible. The cooling ribs extend laterally beside the LED, so that air is able to flow along the cooling ribs beside the LEDs, by which means the discharge of heat from the cooling ribs to the environment is forced.

Very effective heat removal is particularly important when the lamp has a very powerful light source. This is typically the case in lamps which are provided to illuminate large rooms or halls, such as "high-bay lamps". The latter are provided to be suspended at a great height, for example approximately 12 m over the floor of a hall. There are corresponding lamps which generate a luminous flux output of more than 10,000 lm.

The invention is based on the object of specifying a corresponding improved lamp. In particular, the intention is to arrange for the lamp to be configured in a material-saving manner and to be distinguished by an improved thermal behavior.

According to the invention, this is achieved with the subject matter recited in the independent claim. Particular types of embodiment of the invention are specified in the dependent claims.

The invention provides a lamp which has a light source with a plurality of light output elements, the lamp having first passage openings next to the light source on a first side and second passage openings next to the light source on a second side. The first and the second passage openings are designed for an air flow for cooling the light source. The lamp also has a first air-conducting surface next to the first passage openings on the first side and below the light source and a second air-conducting surface next to the second passage openings on the second side and below the light source, wherein the two air-conducting surfaces are designed in such a way that they form an air incidence region that expands away from the light source.

The air incidence region formed by the two air-conducting surfaces means that air is deflected to the passage openings in a particularly targeted manner. In this way, a flow through the passage openings is forced, and therefore a particularly intensive discharge of heat from the surfaces of the passage openings to the environment is made possible. In this way, particularly effective cooling of the light source is achieved.

Preferably, the lamp is configured in such a way that the first air-conducting surface directly adjoins the first passage openings and/or the second air-conducting surface directly adjoins the second passage openings. In this way, air is conducted to the corresponding passage openings by the air-conducting surfaces in a particularly targeted manner.

Preferably, the first air-conducting surface is configured to be planar or curved, at least to a first approximation, and at the same time in particular has a first surface normal which encloses a first angle with a vertical which is between 20° and 85°, preferably between 30° and 70°, particularly preferably between 35° and 60°. In this way, particularly effective air conduction is made possible. Furthermore, the second air-conducting surface is preferably also configured to be planar or curved, at least to a first approximation, and at the same time has in particular a second surface normal which encloses a second angle with the vertical which is between 20° and 85°, preferably between 30° and 70°, particularly preferably between 35° and 60°. In this way, too, particularly effective air conduction is made possible.

Particularly good thermal conduction and at the same time simple configuration is made possible if the first passage openings and/or the first air-conducting surface are configured as parts of a heat sink.

Preferably, the heat sink has vertically extending cooling ribs, in particular on a side opposite the first air-conducting surface. If the heat sink is configured in such a way that only connecting regions, the surfaces of which are inclined with respect to the horizontal by at least 30°, preferably at least 40°, are formed between the cooling ribs, a possible deposition of dust or the like during operation of the lamp can be reduced effectively.

The first air-conducting surface and/or the second air-conducting surface are advantageously configured to be reflective, preferably white, in particular white painted. In this way, they can act as a reflector for light emitted by the light source. In particular, in this way an emission range of the lamp can be influenced or limited.

Preferably, the second air-conducting surface is formed by an outer surface of a housing, the housing preferably being configured for the mounting of an operating device of the lamp. In this way, the lamp can be configured in a particularly material-saving way and at the same time thermally advantageously. The lamp is further preferably thermally advantageously configured in such a way that the housing has an interior, the vertical projection of which extends outside the vertical projection of the light source.

The housing is advantageously configured thermally and in terms of manufacturing technology in the form of a profile.

Particularly suitable thermal isolation between the housing or the operating device located in the latter, on the one hand, and the light source, on the other hand, can be achieved if the housing is connected to the heat sink in a manner held mechanically solely via a screw connection.

The lamp preferably also has a further light source, which is arranged on the second side next to the housing, wherein the further light source is preferably configured in an analogous or identical way to the first-named light source. At the same time, the lamp also preferably has a further heat sink for cooling the further light source, which is arranged on the second side next to the housing, wherein the further heat sink is preferably configured in an analogous or identical way to the first-named heat sink.

A lamp which is particularly advantageous in terms of output and manufacturing technology can be achieved if the lamp is configured symmetrically with reference to a vertical plane of symmetry. The plane of symmetry preferably extends through the housing.

Figure 2:
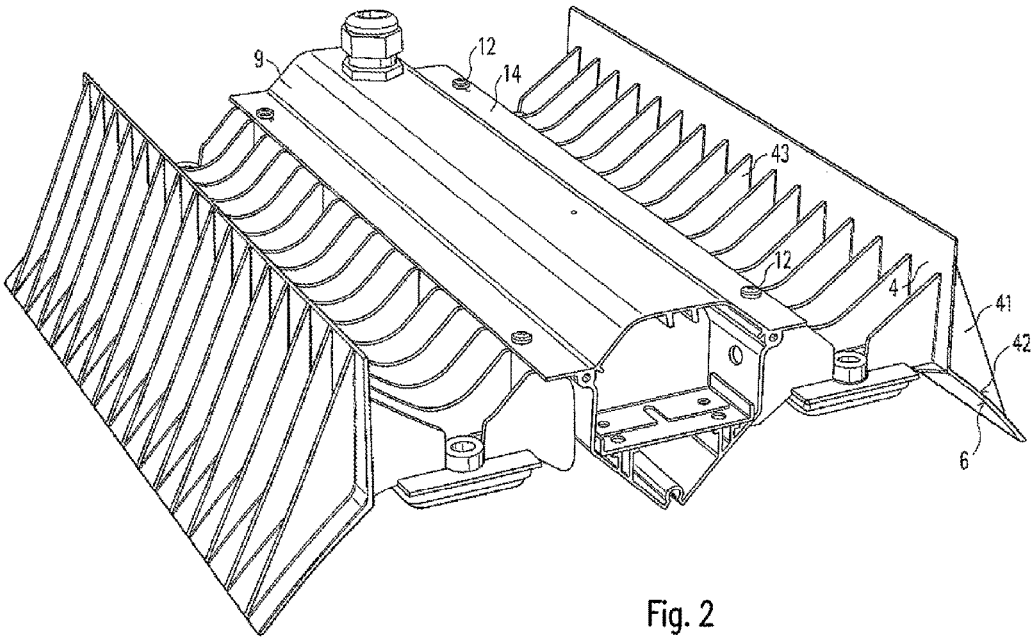
Figure 3:
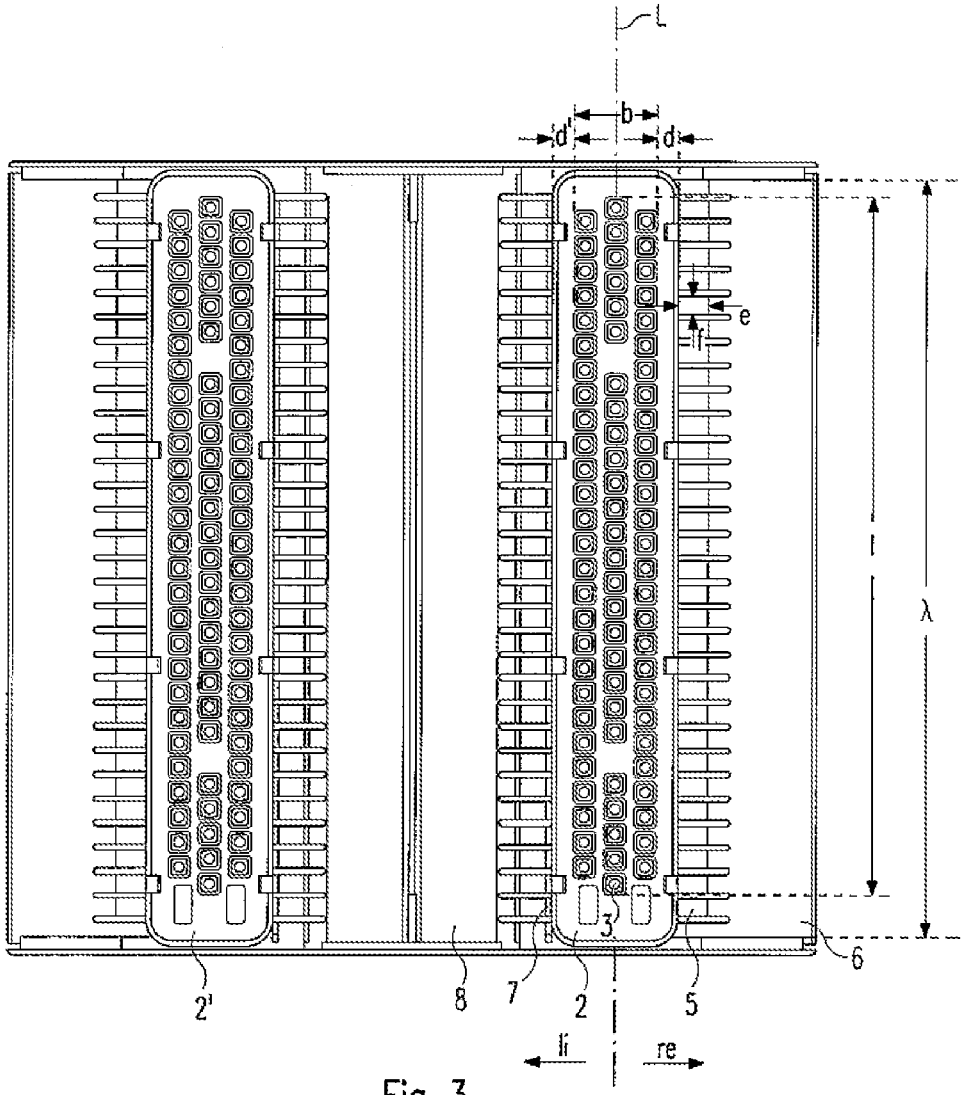
Figure 4:
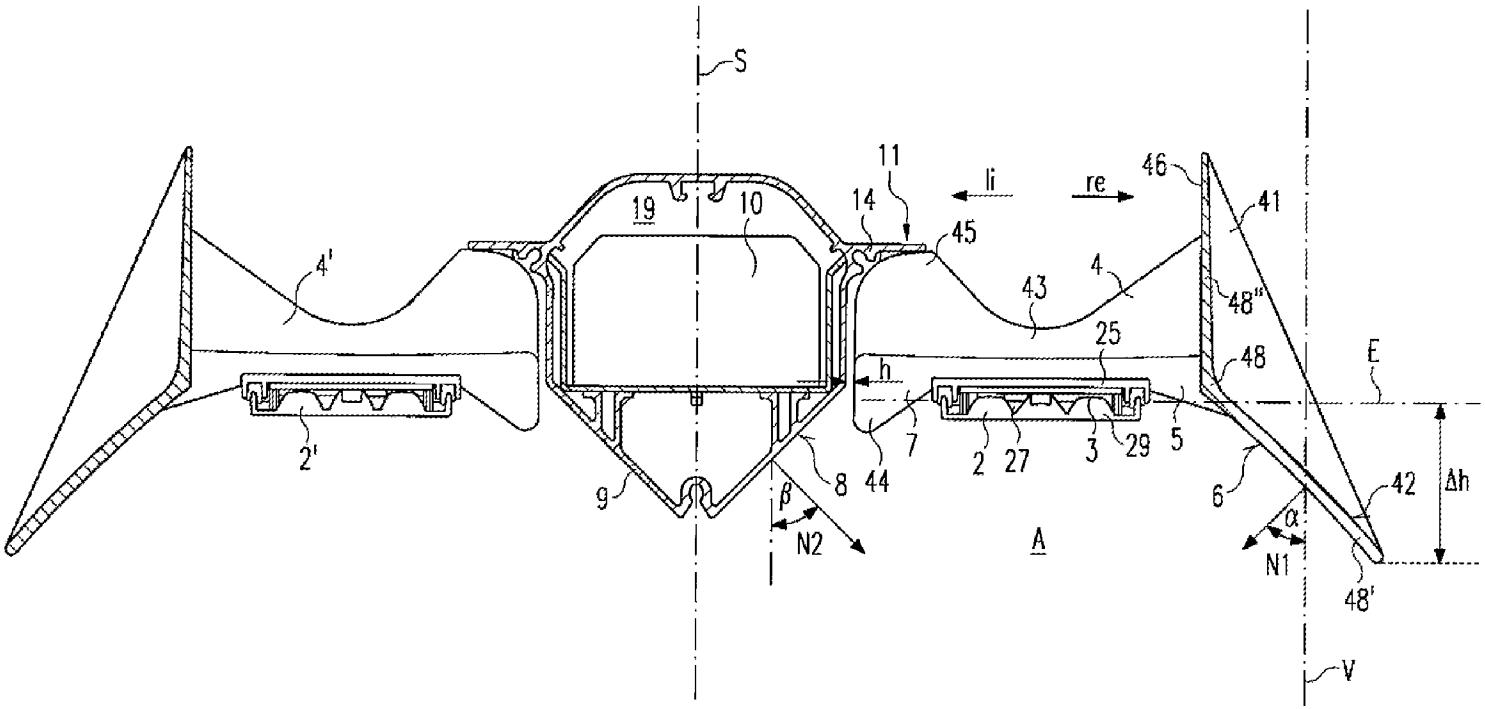
Figure 5:
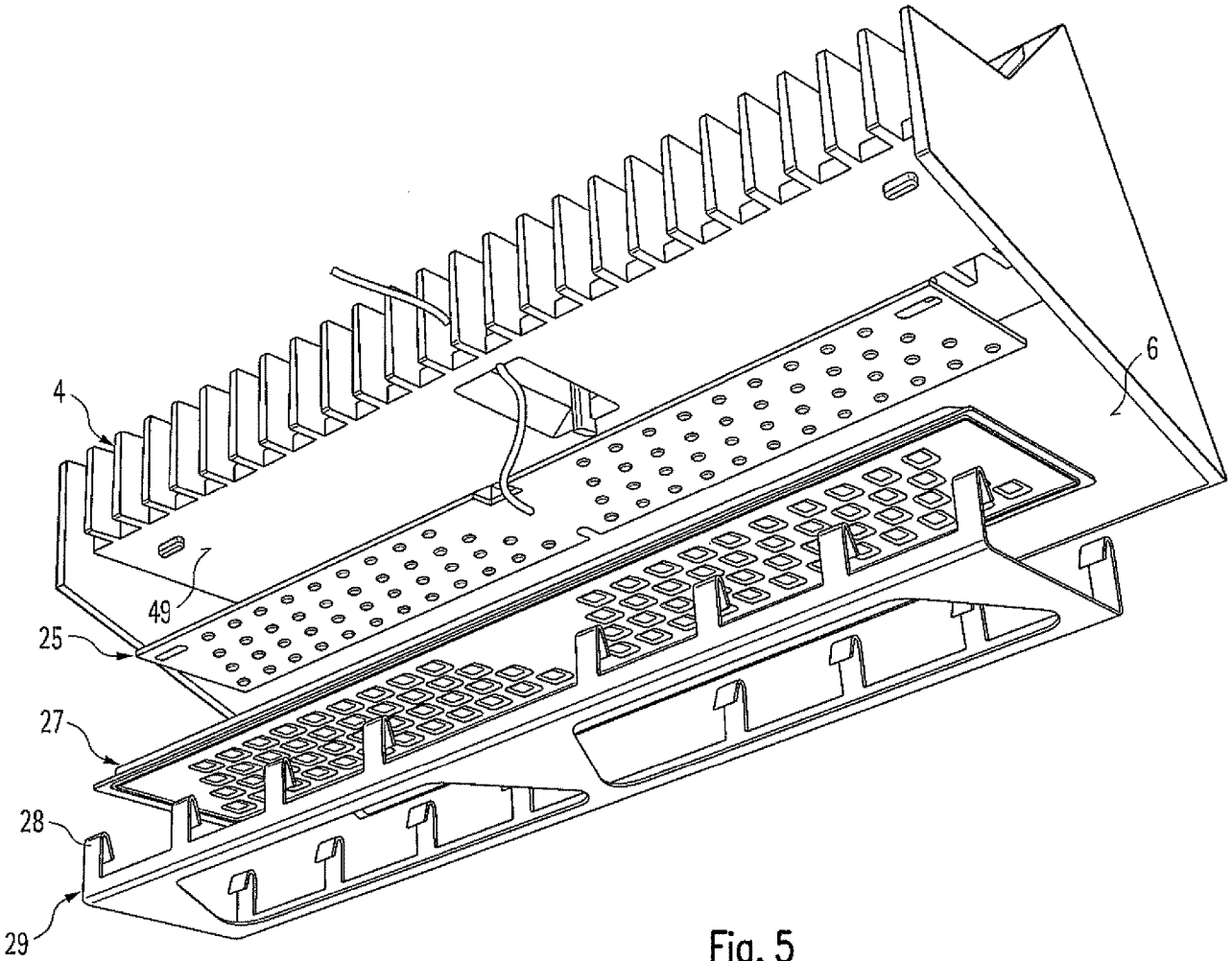

The invention will be explained in more detail below by using an exemplary embodiment and with reference to the drawings, in which:

FIG. 1 shows a perspective sketch of a lamp according to the invention obliquely from below, FIG. 2 shows a corresponding sketch obliquely from above, FIG. 3 shows a view from below, FIG. 4 shows a cross-sectional sketch, and FIG. 5 shows a sketch in the manner of an exploded illustration relating to structure and mounting of the light source on the heat sink.

In FIG. 1, an exemplary embodiment of a lamp according to the invention is sketched obliquely from below. The lamp shown here is a "high-bay lamp", that is to say an internal lamp which is provided to illuminate large rooms or halls and is correspondingly powerful. In the example shown, the lamp is a suspended lamp which is provided to be operated while suspended from a ceiling on a pendulum or a similar suspension element. Accordingly, the lamp is conceived to be arranged for operation in a room in such a way that it is surrounded on all sides by room air.

The lamp has a light source 2 with several light emitting elements 3 in the form of LEDs. The LEDs are preferably arranged on an LED circuit board 25.

In FIG. 3, a view of the lamp from below is sketched. The light source 2 in the example shown is configured to be elongated, so that it extends along a longitudinal axis L.

The LEDs of the light source 2 are arranged in the manner of an array or matrix. In particular, the light source 2 can comprise a plurality of LEDs, preferably more than 30 LEDs, particularly preferably more than 50 LEDs. In this way, an appropriately high luminous flux can be generated with the lamp.

The LEDs extend over a horizontal LED area which has a length l in the direction of the longitudinal axis L and a width b transversely thereto. The ratio l:b can be between 4:1 and 20:1, for example, particularly preferably between 5:1 and 15:1.

With reference to the light source 2 and the longitudinal axis L, the lamp has first passage openings 5 horizontally on a first side re, here on the right next to the light source 2, and second passage openings 7 on a second side li, here on the left next to the light source 2. In particular, the second side li is oriented exactly counter to the first side re.

The first and second passage openings 5, 7 are configured for an air flow for cooling the light source 2. The first and the second passage openings 5, 7 can be formed by slots. The first and the second passage openings 5, 7 are preferably configured as nozzles which effect an increase in the velocity of air flowing through. In this way, the cooling effect can be reinforced.

The configuration is preferably such that the first passage openings 5 extend parallel to the longitudinal axis L and at the same time preferably extend over the entire length l of the LED area. In the example shown, the first passage openings 5 are formed in a row, that is to say in one row, so to speak.

Further preferably, the first passage openings 5 are formed, so to speak, directly next to the light source 2; for example, provision can be made for a distance d transversely with respect to the longitudinal axis L between the LEDs and the first passage openings 5 to be smaller than the width b of the LED area.

The first passage openings 5 are in particular configured in such a way that air can flow through them from bottom to top. The first passage openings 5 are preferably configured in such a way that, viewed in a horizontal cross section, they are closed on all sides. The configuration is also preferably such that—viewed in the horizontal cross section—for each of the first passage openings 5 an internal diameter e transversely with respect to the longitudinal axis L is smaller than the width b of the LED area. The cross-sectional shape of the first passage openings 5 can be circular or rectangular to a first approximation, in particular the ratio of an internal diameter fin the direction of the longitudinal axis L to the internal diameter e, that is transversely thereto, being between 0.3 and 3, particularly preferably between 0.5 and 2.

The second passage openings 7 also preferably extend parallel to the longitudinal axis L and at the same time, so to speak, directly next to the light source 2; for example provision can be made—in a manner analogous to that above—for a further distance d' transversely with respect to the longitudinal axis L between the LEDs and the second passage openings 7 to be smaller than the width b of the LED area.

In FIG. 2, a perspective view of the lamp is sketched obliquely from above, in FIG. 4 a cross section normal to the longitudinal axis L. As indicated in FIG. 4 and already mentioned above, the LEDs or the LED area is/are preferably arranged in a horizontal plane E.

The lamp also has a first air-conducting surface 6 on the first side re or on the right next to the first passage openings 5 and below the light source 2 and the plane E, and a second air-conducting surface 8 on the second side ii or on the left next to the second passage openings 7 and likewise below the light source 2 and the plane E. The two air-conducting surfaces 6, 8 are configured in such a way that they form an air incidence region A that expands away from the light source 2. In particular, the air-conducting surfaces 6, 8 can be configured in such a way that they diverge in a direction away from the light source 2, in particular downward. The air incidence region A, which is formed by the two air-conducting surfaces 6, 8, is funnel-shaped—in particular viewed in a cross section normal to the longitudinal axis L, narrowing upward toward the light source 2.

The two air-conducting surfaces 6, 8 enable air which enters the air incidence region A from below to be deflected specifically to the first and second passage openings 5, 7. The discharge of heat from the inner walls of the passage openings 5, 7 to the environment is forced significantly as a result.

In the example shown, the two air-conducting surfaces 6, 8 are configured in the form of profiles, each extending parallel to the longitudinal axis L. As sketched by way of example in FIG. 3, the first air-conducting surface 8 preferably has a longitudinal extent λ in the direction of the longitudinal axis L which is at least half as great as the length l of the LED area; the longitudinal extent λ is preferably at least three quarters of the length l. As revealed by FIG. 3, in the example shown $\lambda>1$. This is similarly true of the corresponding longitudinal extent of the second air-conducting surface 8.

The first air-conducting surface 6 preferably has a surface size which is at least as large as half the surface size of the LED area, particularly preferably at least as large as the surface area of the LED area. This is similarly true of the surface size of the second air-conducting surface 8.

As shown in FIG. 6, the first air-conducting surface 6 extends downward to a level which lies below the plane E by a vertical difference $\Delta h$, where it is preferably true that this vertical difference $\Delta h$ is at least half as great as the width b of the LED area, that is to say oh>0.5b. Preferably, $\Delta h>0.9$ b. This is again similarly true of the second air-conducting surface 8.

In the example shown, the configuration is such that the first air-conducting surface 6 directly adjoins the first passage openings 5. In this way, the air is conducted directly to the first passage openings 5. This is similarly true of the second air-conducting surface 8 and the second passage openings 7.

The first air-conducting surface 6 is preferably configured to be planar or curved, at least to a first approximation, in particular concavely curved, having a first surface normal NI which encloses a first angle $\alpha$ with a vertical V which is between 20° and 85°. Preferably, the first angle $\alpha$ is between 30° and 70°, about 45° in the example shown. The same is again true in relation to the second air-conducting surface 8, which accordingly has a second surface normal N2 which encloses a second, correspondingly large angle $\beta$ with the vertical V.

A particularly simple configuration can be achieved if the first passage openings 5 are configured as parts of a heat sink 4, the heat sink 4 being configured in particular for cooling the light source 2. The heat sink 4—as known intrinsically from the prior art—is highly thermally conductively connected to the light source 2.

Shown in FIG. 5 is a sketch in the manner of an exploded illustration, which represents a slightly modified embodiment. As emerges by way of example from this figure, the heat sink 4 preferably has a horizontal, planar surface 49 pointing downward, on which the light source 2 or the LED circuit board 25 is arranged.

Following the LEDs optically, an optical element 27 to influence a light emitted by the LEDs and/or a transparent covering element to protect the LEDs can be provided. The optical element 27 and the covering element are preferably configured in such a way that they extend toward the first side re at most as far as the first passage openings 5 and toward the second side li at most as far as the second passage openings 7.

For the mechanical retention of the LED circuit board 25 and, if appropriate, of the optical element 27 or the covering element, a retaining element 29 which holds the aforementioned components by engaging around from below is preferably provided. The retaining element 29 preferably has latching elements 28, which are designed for the mechanical connection to the heat sink 4.

In the example shown, the first air-conducting surface 6 is advantageously also formed by the heat sink 4. The heat sink 4 preferably consists of one piece, is therefore preferably in one piece. For example, it consists of aluminum.

Furthermore, the heat sink 4 advantageously has cooling ribs 41—designated by way of example in FIG. 4—in particular on a side opposite the first air-conducting surface 6, that is to say on the first side re or on the right of the first air-conducting surface 6. In this way, it is possible, in a material-saving way, for connecting regions with surfaces 42 to be formed solely between the cooling ribs 41 by the heat sink 4, said surfaces being inclined with respect to the horizontal, preferably inclined by at least 30°, particularly preferably at least 40°. In the example shown—in a particularly material-saving way—the surfaces 42 on the right of the first air-conducting surface 6 are approximately as highly inclined as the first air-conducting surface 6, that is to say about 45°. By means of appropriately inclined surfaces 42, during operation of the lamp—as compared with a corresponding horizontal surface configuration—a deposition of dust, dirt etc. can be avoided particularly effectively.

The cooling ribs 41 in the example shown are formed parallel to one another, in particular in planes which are oriented normally with respect to the direction of the longitudinal axis L.

Advantageously, the heat sink 4 additionally has further, in particular vertical, cooling ribs 43, which are configured in such a way that they are designed to project beyond the light source 2 on the first side re or on the right and on the second side li or on the left. A region 44 of the further cooling ribs 43 that projects on the second side li can be configured so as to form the second passage openings 7, a region projecting on the first side re can be configured so as to form the first passage openings 5. Like the first-named cooling ribs 41, the further cooling ribs 41 are also formed parallel to one another in the example shown, particularly in planes which are oriented normally with respect to the direction of the longitudinal axis L.

Preferably, the first air-conducting surface 6 is configured to be reflective, for example white, in particular white painted. In this way, the light emission from the lamp can be influenced advantageously. In particular—depending on the inclination of the first-air-conducting surface 6—lateral limitation of the light emission toward the first side re can be effected. The same is true with reference to the second air-conducting surface 8 on the second side li. In other words, in this way it is possible to define an angular range over which emission of light from the lamp takes place.

By means of an appropriately white configuration of the two air-conducting surfaces 6, 8, it is additionally achieved that, when viewed from below, the lamp exhibits a relatively large, brightly luminous surface, via which light is emitted.

Preferably, the second air-conducting surface 8 is formed by an outer surface of a housing 9. The housing 9 can in particular be configured for the mounting of an operating device 10, for example in the form of a converter of the lamp. In this way, it is advantageously possible for the operating device 10 to be arranged laterally next to the light source 2, here on the second side ii next to the light source 2. This is advantageous since the operating device 10 can, so to speak, be arranged to be thermally isolated from the light source 2 as a result. In particular, the configuration can be such that the operating device 10 is arranged outside the vertical projection of the light source 2, particularly preferably outside the vertical projection of the heat sink 4.

For this purpose, the housing 9 can have an interior 19, the vertical projection of which extends outside the projection of the light source 2.

Good thermal isolation between the operating device 10 and the light source 2 is important, since an operating device generally reacts relatively sensitively to high temperatures.

The thermal isolation between the light source 2 and the operating device 10 is further promoted in the example shown by the heat sink 4 being connected to the housing 9 in a manner held mechanically solely via a connection 11 that acts at a point, so to speak, for example a screw connection. For example, only two screws 12—shown by way of example in FIG. 2—can be provided for this purpose. To this end, the housing 10 preferably has a flanged region 14, projecting toward the first side re, on which the connection 11 is formed, the flanged region 14 being located outside the vertical projection of the operating device 10 or the interior 19.

The region 44 of the further cooling ribs 43 of the heat sink 4, projecting on the second side li, is preferably configured in such a way for this purpose that—at the level of the light source 2—it does not quite extend as far as the housing 10 but has a distance h from the latter which is preferably between 1 mm and 10 mm. The second passage openings 7 can therefore be configured on the one hand by the heat sink 4, more precisely by the further cooling ribs 43 on the one hand, and the housing 9, on the other hand.

The flanged region 14 or the connection 11 is preferably formed at a level above the plane E, in particular above the light source 2. The heat sink 4 is advantageously shaped in such a way that, on the second side li, it has a region 45 that projects upward, at the upper end of which the connection 11 is formed.

Advantageously in terms of flow, the heat sink 4 additionally has, on the first side re, a further region 46 that projects upward, by which in particular an upper end region of the first passage openings 5 can be formed. In addition, an upper end region of the first-named cooling ribs 41 can be formed by the further region 46 projecting upward.

In the example shown, the heat sink 4 has a portion 48 shaped like a profile, which extends along the longitudinal axis L and—viewed in a cross-section normal to the longitudinal axis L—has two limbs, namely a lower limb 48' and an upper limb 48"; here, the first air-conducting surface 6 is formed by the lower limb 48'. The upper limb 48" extends upward—in particular formed vertically—and forms the highest point of the further region 46 of the heat sink 4 that projects upward. In this way, in particular an embodiment of the first passage openings 5 that is advantageous in terms of flow is achieved.

The housing 9 is advantageously configured as a profiled part, which extends parallel to the longitudinal axis L. This makes particularly simple production of the housing 9 possible. In addition, with this configuration, it is possible to achieve the situation where, in order to install the operating device 10 in the housing 9, the operating device 10 can simply be slid into the housing 9 in the direction of the longitudinal axis L.

A particularly powerful lamp can be achieved if a further light source 2' is provided on the second side li or on the left beside the housing 9, preferably at the same level as the first-named light source 2. In particular, the further light source 2' can be configured in an analogous or identical way to the first-named light source 2. Accordingly further advantageously, the lamp has a further heat sink 4' for cooling the further light source 2', preferably being configured in an analogous or identical way to the first-named heat sink 4.

Particularly preferably, the lamp is configured symmetrically with respect to a vertical plane of symmetry S, which in particular extends parallel to the longitudinal axis L and at the same time through the housing 9.

The lamp can therefore be constructed modularly, so to speak, a central module comprising the housing 9 with the operating device 10 and an LED module with associated heat sink 4, 4' respectively being arranged on both sides re, li beside the central module. The said modules are preferably connected to each other in a manner held mechanically solely via the aforementioned screw connections.

By using the lamp according to the invention, luminous fluxes of more than 10,000 lm can be generated. At the same time, the lamp is also suitable, for example, to be connected to a further, identical lamp, so that the two lamps are arranged one after another in alignment in the direction of the longitudinal axis L. The luminous flux which is output by the two lamps together is then accordingly twice as high as the luminous flux from one of the two lamps.

The invention claimed is:

1. A lamp, comprising:

a light source with a plurality of light output elements, and a lamp body having first passage openings next to the light source on a first side and second passage openings next to the light source on a second side, the first and the second passage openings being designed for an air flow for cooling the light source, wherein the lamp body also having a first air-conducting surface next to the first passage openings on the first side located below the light source and a second air-conducting surface next to the second passage openings on the second side below the light source, wherein the two air-conducting surfaces are designed in such a way that they form an air incidence region that expands away from the light source wherein the second air-conducting surface is formed by an outer surface of a housing, the housing being configured to mount an operating device of the lamp body, and wherein at least one of the first passage openings and the first air-conducting surface are configured as part of a heat sink, in which the housing is connected to the heat sink in a manner held mechanically solely via a screw connection.

2. The lamp as claimed in claim 1, wherein the first air-conducting surface directly adjoins the first passage openings, and/or the second air-conducting surface directly adjoins the second passage openings.

3. The lamp as claimed in claim 1, in which the first air-conducting surface is planar or curved, at least to a first approximation, and has a first surface normal which encloses a first angle with a vertical which is between 20° and 85.

4. The lamp as claimed in claim 3, in which the second air-conducting surface is planar or curved, at least to a first approximation, and preferably has a second surface normal which encloses a second angle with the vertical which is between 20° and 85°, preferably between 30° and 70°, particularly preferably between 35° and 60°.

5. The lamp as claimed in claim 1, in which at least one of the first passage openings and the first air-conducting surface is configured as part of a heat sink.

6. The lamp as claimed in claim 5, in which the heat sink has vertically extending cooling ribs, on a side opposite the first air-conducting surface.

7. The lamp as claimed in claim 6, in which the heat sink has connecting regions, the surfaces of which are inclined with respect to horizontal by at least 30°, formed between the cooling ribs.

8. The lamp as claimed in claim 1, in which the first air-conducting surface and/or the second air-conducting surface are white painted.

9. The lamp as claimed in claim 1, wherein the housing has an interior, a vertical projection which extends outside a vertical projection of the light source.

10. The lamp as claimed in claim 1, in which the housing is configured in the form of a cross-sectional profile extending along a longitudinal axis.

11. The lamp as claimed claim 1, further having a further light source, which is arranged on the second side next to the housing, wherein the further light source is configured in an analogous or identical way to the first-named light source.

12. The lamp as claimed in claim 11, further having a further heat sink for cooling the further light source, which is arranged on the second side next to the housing, wherein the further heat sink is configured in an analogous or identical way to the first-named heat sink.

13. The lamp as claimed in claim 11, which is configured symmetrically with reference to a vertical plane of symmetry, wherein the plane of symmetry extends through the housing.

* * * * *